United States Patent [19]

Santilli

[11] 4,200,906

[45] Apr. 29, 1980

[54] LIGHTING STANDARD SUPPORT

[76] Inventor: Alexander J. Santilli, Lakeside Ave., 393C, Lakeville, Mass. 02346

[21] Appl. No.: 852,715

[22] Filed: Nov. 18, 1977

[51] Int. Cl.[2] ..... F21S 1/10; F21S 3/10; F21S 13/10

[52] U.S. Cl. ..... 362/431; 52/298; 248/158; 362/382; D26/151

[58] Field of Search ..... 52/298, 295, 296, 297; 248/158; D48/37; 362/382, 431, 403, 391

[56] References Cited

U.S. PATENT DOCUMENTS

| | | | |
|---|---|---|---|
| D. 68,034 | 8/1925 | Doty | D48/37 |
| 749,337 | 1/1904 | Stewart et al. | 52/295 |
| 1,579,909 | 4/1926 | Barkschat | 362/431 |
| 1,805,731 | 5/1931 | Beckwith | 52/296 |
| 1,884,247 | 10/1932 | Riemenschneider | 52/295 |
| 1,903,907 | 4/1933 | Riemenschneider | 52/295 |
| 3,125,190 | 3/1964 | Brennan | 52/295 |
| 3,343,322 | 9/1967 | Lurkis et al. | 362/431 |
| 3,552,073 | 1/1971 | Millerbernd | 52/296 |

*Primary Examiner*—Harold J. Tudor
*Attorney, Agent, or Firm*—John E. Toupal

[57] ABSTRACT

A pole support including a housing that defines a base portion for mounting on a support surface, a cavity for accommodating electrical equipment, a receiver opening for receiving a pole and communicating with the cavity, an access opening providing physical access to the cavity, and a plurality of bolt holes physically accessible externally of the cavity. Covering the access opening is a door that can be opened to expose the electrical gear in the cavity. Also removably secured to the housing are covers for retaining bolts disposed in the bolt holes.

8 Claims, 4 Drawing Figures

LIGHTING STANDARD SUPPORT

BACKGROUND OF THE INVENTION

This invention relates generally to pole supports and, more particularly, to bases for supporting lighting standards.

Vertical standards are used extensively to support lighting equipment such as traffic lights, floodlights, etc. Generally, the standards are mounted on hollow bases that accommodate electrical gear associated with the lighting equipment supported. In most instances the bases are secured to a primary support surface with internally located bolts. Because the interior of the base is typically crowded with electrical cables and other gear, access to the internal bolts is limited. Consequently, installation or removal of the pole bases is rather difficult and time consuming. Another problem associated with prior lighting standard bases stems from the common use of lightweight materials such as aluminum. Although desirable for other reasons, the threaded openings in aluminum bases often fail to offer the structural strength required to support relatively heavy metal standards.

The object of this invention, therefore, is to provide an improved base for lighting standards.

SUMMARY OF THE INVENTION

The invention is a pole support including a housing that defines a base portion for mounting on a support surface, a cavity for accommodating electrical equipment, a receiver opening for receiving a pole and communicating with the cavity, an access opening providing physical access to the cavity, and a plurality of bolt holes physically accessible externally of the cavity. Covering the access opening is a door that can be opened to expose the electrical gear in the cavity. Also removably secured to the housing are covers for retaining bolts disposed in the bolt holes. The use of external retaining bolts greatly simplifies installation of the pole support while the bolt covers protect the bolts from grime and corrosion and enhance the overall appearance of the structure.

One feature of the invention is a method of fabricating the housing including the steps of forming a mold with a cavity having the shape of the desired housing, forming an annular insert of a high strength material such as steel, internally threading the annular insert, positioning the annular insert in the mold cavity in a position surrounding the receiver opening, filling the mold cavity with a molten material such as aluminum having less weight and strength than the material used for the insert, and removing from the mold as an integral unit the cast housing and annular insert. By integrally casting a lightweight housing with a high strength threaded insert, the finished product is easily handled, of reasonable cost and able to reliably accommodate threaded engagement with a relatively heavy metal post.

In a preferred embodiment of the invention, the housing comprises a pedestal portion extending from the base portion in the form of a truncated pyramid, the vertex of which defines the receiver opening, and bolt holes that open into recesses located at the intersections of the bases forming the truncated pyramid. The bolt covers extend over the recesses and conform to the natural shape of the pyramid. Preferably, the pedestal portion has the form of an octahedron and the bolt receiving recesses are located at alternate intersections of the faces forming the octahedron.

DESCRIPTION OF THE PREFERRED EMBODIMENT

Figure 1:
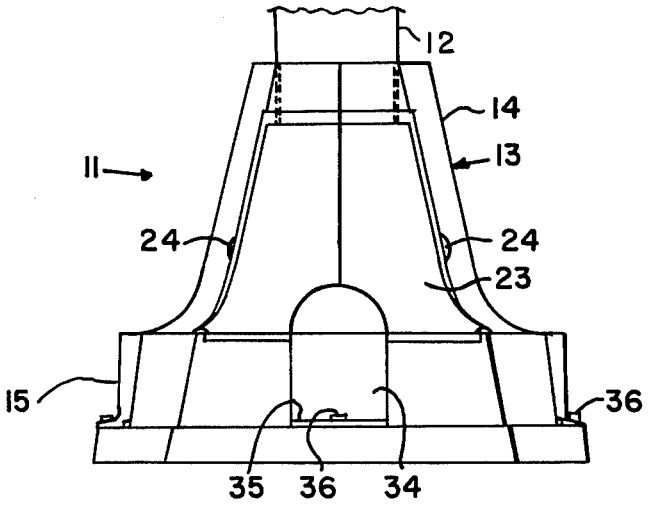
FIG. 1 is a schematic elevational view of a preferred embodiment of the invention.
Figure 2:
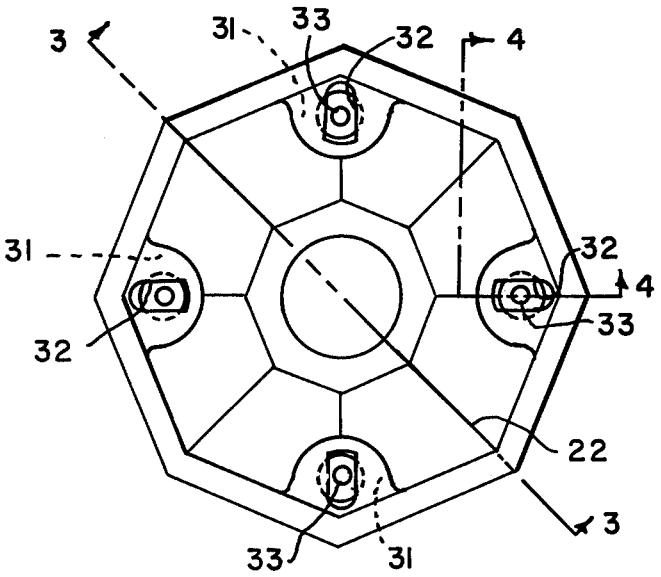
FIG. 2 is a schematic bottom view of the embodiment shown in FIG. 1.
Figure 4:
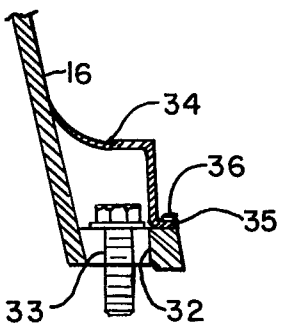
FIG. 4 is a schematic cross-sectional view taken along lines 4—4 of FIG. 2.
Figure 3:
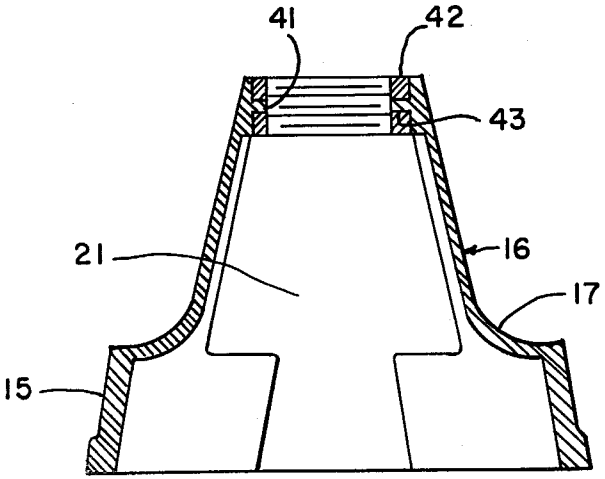
FIG. 3 is a schematic cross-sectional view taken along lines 3—3 of FIG. 2.

As illustrated in FIGS. 1–3, the invention comprises a support 11 for a pole 12 of the type typically utilized to support traffic signal lights (not shown). The support 11 includes a housing 13 formed by a pedestal portion 14 that extends out of an octagonally shaped base portion 15. As shown in the drawings, the pedestal 14 is a truncated pyramid having the form of an octahedron. The faces 16 have concave lower portions 17 that meet the upper peripheral edge of the base portion 15.

Defined by the housing 13 is an internal cavity 21 for accommodating electrical gear such as cables and the like associated with the lights (not shown) normally supported by the pole 12. Physical access to the cavity 21 is provided by an access opening 22 (FIG. 2) formed in two faces of the pedestal portion 14. A door 23 covers the access opening 22 and is removable to provide access to the cavity 21. Removably securing the door 23 to the housing 13 are machine screws 24 that penetrate adjacent faces 16 of the pedestal portion 14. The shape of the cover 23 conforms to the full faces 16 of the pyramidal pedestal portion 14.

Also defined by the outer surface of the housing 13 are a plurality of concave recesses 31 located at alternate intersections of the faces 16 forming the pedestal portion 14. The recesses 31 extend through the base portion 15 and terminate with bolt holes 32. Received by the bolt holes 32 are anchor bolts 33 that are used to anchor the support 11 to a suitable support surface. Each of the recesses 31 is closed by a cover 34 with a lower lip 35 that is removably secured to the base portion 15 with a machine screw 36. The covers 34 conform to the natural shape of the pedestal and base portions 14 and 15.

As shown in FIG. 3, the housing 13 defines a receiver opening 41 at the vertex of the pyramidal pedestal portion 14. The receiver opening 14 communicates with the cavity 21 and is internally threaded to accommodate an externally threaded pipe 12. In a preferred embodiment, the opening 41 is formed by an annular insert 42 made of a material having greater strength than the remainder of the housing 13.

According to a preferred method of the invention, the housing 13 is a sand casting of a suitable material such as aluminum alloy. A mold is formed with a mold cavity conforming to the desired shape of the housing 13 and the insert 42 is positioned in the cavity so as to establish the receiver opening 41. Preferably the insert 42 is a length of internally threaded pipe made of a high strength material such as steel. Prior to insertion into the mold cavity, holes are drilled in the insert 42 to provide recesses 43. Upon filling of the mold, the recesses 43 fill with molten aluminum which after hardening establishes a bond that enhances the structural integrity of the integrally formed housing 13 and annular insert 42.

Obviously, many modifications and variations of the present invention are possible in light of the above teachings. It is to be understood, therefore, that the invention can be practiced otherwise than as specifically described.

What is claimed is:

1. A pole support comprising:

a cast housing defining a base portion for mounting on a support surface; a cavity for accommodating electrical gear; a pedestal portion with a lower portion defining a plurality of recesses and extending from said base portion in the form of a truncated pyramid, the vertex of which defines a receiver opening for receiving a pole and communicating with said cavity; an access opening for allowing physical access to said cavity; and a plurality of externally located holes for receiving bolts that secure said base portion to the support surface and are physically accessible externally of said cavity, each of said holes located in a different one of said recesses;

a removable door means covering said access opening;

door securing means for securing said door means to said housing;

an annular threaded insert cast in said receiver opening and formed from a different material than said housing;

removable cover means for covering bolts disposed in said holes; and cover securing means for securing said cover means to said housing.

2. A pole support according to claim 1 wherein said access opening is disposed in at least one face of said pedestal portion.

3. A pole support according to claim 1 wherein said external recesses are located at the intersections of the faces forming said truncated pyramid.

4. A pole support according to claim 3 wherein said pedestal portion has the form of an octahedron.

5. A pole support according to claim 4 wherein said external recesses are located at alternate intersections of the faces forming said octahedron.

6. A pole support according to claim 4 wherein said cover means comprise a plurality of individual covers, each of which covers one of said recesses.

7. A pole support according to claim 6 wherein said individual covers conform to the natural shape of said octahedron.

8. A pole support according to claim 1 wherein said insert comprises recesses for receiving said given material in molten form.

* * * * *